US007229321B2

(12) United States Patent
Hegel

(10) Patent No.: US 7,229,321 B2
(45) Date of Patent: Jun. 12, 2007

(54) GRIPPER CONTACT

(75) Inventor: Jörg Hegel, Hagen (DE)

(73) Assignee: Lumberg Connect GmbH & Co. KG, Schalksmuhl (DE)

( * ) Notice: Subject to any disclaimer, the term of this patent is extended or adjusted under 35 U.S.C. 154(b) by 16 days.

(21) Appl. No.: 11/124,919

(22) Filed: May 3, 2005

(65) Prior Publication Data

US 2005/0245144 A1 Nov. 3, 2005

(30) Foreign Application Priority Data

May 3, 2004 (DE) ..... 10 2004 021 529

(51) Int. Cl.
*H01R 24/00* (2006.01)

(52) U.S. Cl. ..... 439/637

(58) Field of Classification Search ..... 439/637, 439/631, 630, 79, 80, 78, 260, 857, 892
See application file for complete search history.

(56) References Cited

U.S. PATENT DOCUMENTS 3,040,291 A * 6/1962 Schweitzer et al. ..... 439/637
3,262,082 A 7/1966 Gammel
3,631,381 A * 12/1971 Pittman ..... 439/637
3,858,957 A 1/1975 Harwood
5,082,459 A * 1/1992 Billman et al. ..... 439/637
6,254,435 B1 * 7/2001 Cheong et al. ..... 439/637
6,652,372 B2 * 11/2003 Muller ..... 454/159
6,764,345 B1 * 7/2004 Duesterhoeft et al. ..... 439/637

FOREIGN PATENT DOCUMENTS

| | | |
|---|---|---|
| CH | 424905 | 11/1968 |
| DE | 1 046 137 | 4/1957 |
| DE | 28 09 830 | 9/1978 |
| DE | 30 23 614 | 1/1982 |

* cited by examiner

*Primary Examiner*—Alexander Gilman
(74) *Attorney, Agent, or Firm*—Andrew Wilford

(57) ABSTRACT

An electrical contact has a pair of arms extending generally parallel to and spaced apart transversely of an insertion direction and defining a slot open outward in the insertion direction. Each arm outer end has an end face extending at an acute angle to the direction. The end faces diverge outward from each other in the direction, and a bight interconnects the arm inner ends. The arms are limitedly elastically deformable for elastic displacement of the arm outer ends perpendicular to the direction so that a part can be pressed against the end faces to elastically spread the arm outer ends. An inner contact bump projects on each arm between the respective end face and the bight transversely of the direction into the slot. An outer bump projects on each arm from between the respective inner bump and the respective end face transversely of the direction into the slot.

7 Claims, 6 Drawing Sheets

GRIPPER CONTACT

FIELD OF THE INVENTION

The present invention relates to an electrical contact. More particularly this invention concerns a gripper contact for engagement with an edge of a circuit board, contact blade, or the like.

BACKGROUND OF THE INVENTION

Figure 6:
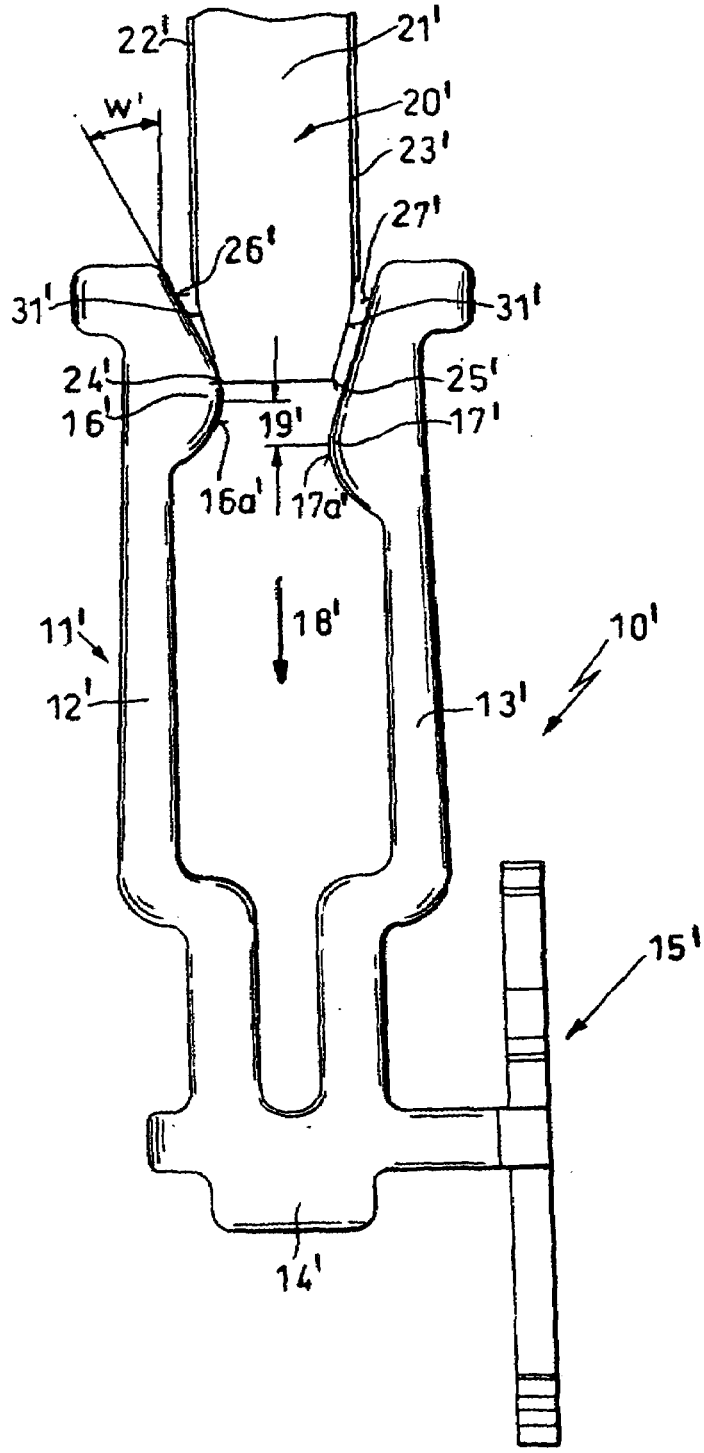
FIG.6 PRIOR ART
FIG. 6 is a view like FIG. 1 of a prior-art contact.

It is standard practice as shown in FIG. 6 (see also German patent 3,023,614) to make an electrical connection to an edge of a printed circuit board 20' or to a metallic or metal-plated plastic contact by means of a forked contact assembly 10' having two arms 12' and 13' defining a slot into which the board 20' or the like is fitted. The two arms 12' and 13' are joined at their inner ends by a bight 14' in turn formed as part of a terminal 15' that is in its turn connected to an unillustrated circuit element. In practice a row extending perpendicular to the plane of the FIG. 6 view of the contacts 11' is provided, each one making a contact with a respective trace on the board 21', and as described in German patent 1,046,137, contact bumps 16' and 17' of the contacts 12' and 13' can be set at different levels. Each contact 11' is normally stamped out of sheet steel and plated at least on the surfaces 16*a*' and 17*a*' with a highly conductive metal like gold or copper.

The arms 12' and 13' are formed with contact bumps 16' and 17' having surfaces 16*a*' and 17*a*' that are offset in an insertion direction 18' lying on a central plane of the contact 11' by a short distance 19' so as to form two differently angled faces 26' and 27'. The circuit board 20 has a dielectric rigid core plate 21' with conductive traces 22' and 23' on its opposite faces. At its edge inserted into the contact 11' it has two sharp edges 24' and 25'. In order to prevent these edges 24' and 25' from digging too deeply into the normally soft metal—copper or gold—coating the faces 16*a*' and 17*a*', the edges are beveled off at 31'.

The offset 19' is intended to make it easier to fit the board 20' into the contact 11'. Normally it will engage the one arm 11' and pry it out, then hit the other arm 13', so that they will not both engage it at the same time. The face 26 extends at an angle W' of about 30° to the direction 18'. Combined with the bevel 31', the edge 24' meets the face 26' at a fairly flat angle, in theory minimizing any tendency of it to dig in. The use of such a flat angle limits the throat or width of the opening defined between the arms 12' and 13', but is necessary to prevent damage to the contact assembly 10'.

Such a contact assembly 10', used for example to fit to the edge of the printed-circuit connector of a liquid-crystal display, can be made relatively compact and, by virtue of the gripping action, maintains a good electrical connection with the part that if fitted in it. When, however, it is intended for an application, for instance in a cell phone, where it is subject to frequent plugging-in and unplugging of some other piece of equipment, it can quickly wear out. Even with the bevels 31', the edges 24' and 25' cut into the surfaces 16*a*' and 17*a*', with the result that the conductive coating is damaged and the electrical connection becomes intermittent or develops significant resistance.

It is known, for example from German 2,809,830, U.S. Pat. No. 3,858,957, and U.S. Pat. No. 3,262,082, to shape the outer ends of the contacts to guide the part into the slot formed between the contact arms. In these systems, the outer ends are spaced somewhat more widely than the actual contact bumps that eventually serve for conducting electricity to and/or from the part fitted to the contact, so that they are in fact exposed to damage as explained above and offered no significant protection by the outer formations.

OBJECTS OF THE INVENTION

It is therefore an object of the present invention to provide an improved gripper contact.

Another object is the provision of such an improved gripper contact that overcomes the above-given disadvantages, in particular that can be counted on to have a long service life, even with repeated use.

SUMMARY OF THE INVENTION

An electrical contact has according to the invention a pair of arms extending generally parallel to and spaced apart transversely of an insertion direction, each having an outer end and an inner end, and defining a slot open outward in the insertion direction. Each arm outer end has an end face extending at an acute angle to the direction. The end faces diverge outward from each other in the direction, and a bight interconnects the arm inner ends. The arms are limitedly elastically deformable for elastic displacement of the arm outer ends perpendicular to the direction so that a part pressed in the insertion direction against the end faces elastically spreads the arm outer ends. An inner contact bump projects on each arm between the respective end face and the bight transversely of the direction into the slot. The inner bumps are spaced apart transverse to the direction by a predetermined inner spacing. An outer bump projects on each arm from between the respective inner bump and the respective end face transversely of the direction into the slot. The outer bumps are spaced apart transverse to the direction by a predetermined outer spacing equal at most to the inner spacing.

Thus with this system, as a part is pushed into the slot, it will first engage the end faces and spread the arms until the part has slipped between the outer bumps. Further inward movement will engage it between the inner bumps, but by the time the part actually enters into contact with the inner bumps they will be spread to a spacing equal almost to that of the outer bumps. According to the invention in a relaxed condition of the contact the inner and outer spacings are generally the same. Since the arms are connected together by the bight at their inner ends, the spacing between the inner bumps will be slightly less than that of the outer bumps, even if they start out at identical spacing, when the outer ends are levered apart. This system is particularly effective in arrangements where the part being inserted into the contact moves in a straight line, not where it can be tipped from one side to the other and worked into place.

The acute angle formed by the outer end faces to the direction is between 40° and 50°. This does, admittedly, make it possible for sharp edges on the inserted part to scrape on these faces, but since they are not used for electrical connection this is not serious. On the other hand, the wide angle provides a big mouth for the slot, making it easy to insert the part thereinto.

The inner bumps each have a flat outer flank forming an angle of between 15° and 30° to the direction. The outer flanks diverge outward in the direction. This extremely small angle ensures that the part, as it slides onto the inner bumps, will not be likely to dig into the metal coating on these bumps.

The bumps are unitarily formed with the respective arms. The arms can be solid metal or plastic-coated metal, as in a molded interconnect device system.

In addition inner bumps are spaced directly across from each other perpendicular to the direction while one of the outer bumps is spaced in the direction outward of the other of the outer bumps. Thus the part will engage the one outer bump, and then shift laterally into position as it bends out the one arm, making the action of insertion into the slot fairly gentle.

SPECIFIC DESCRIPTION

Figure 3:
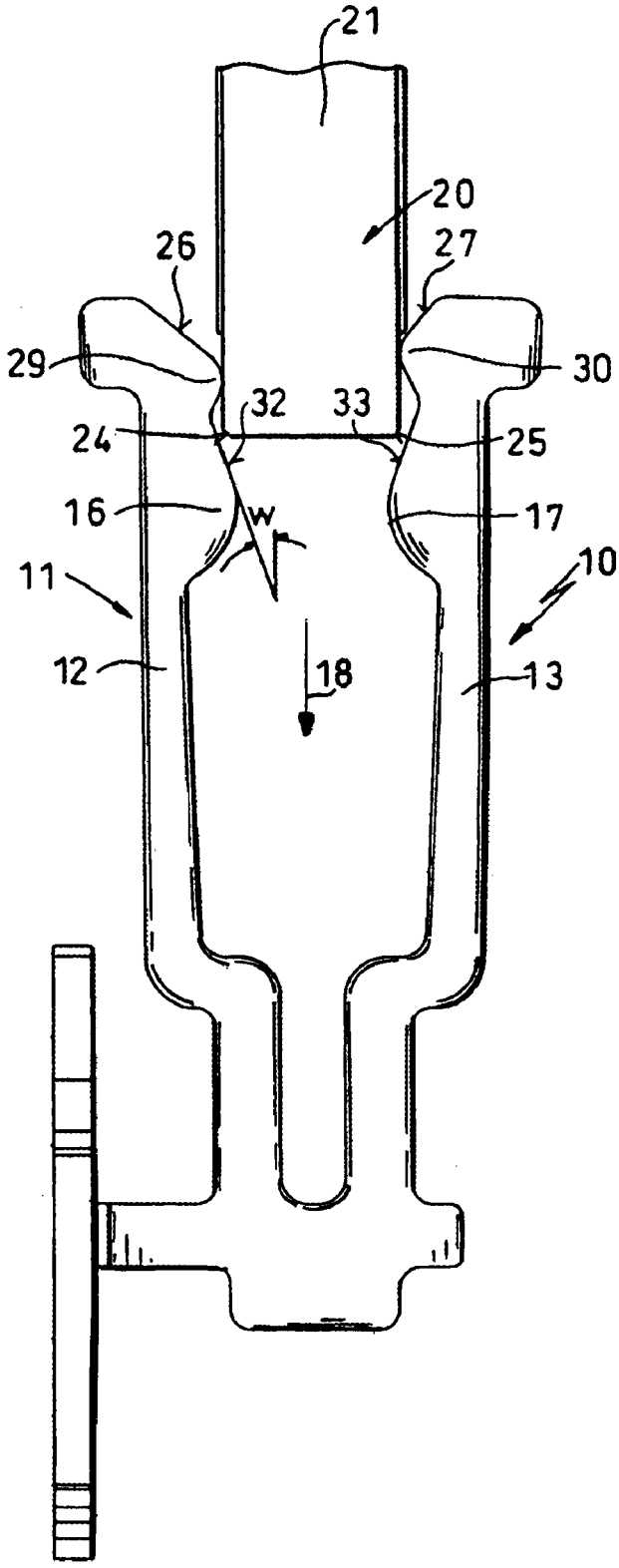
Figure 4:
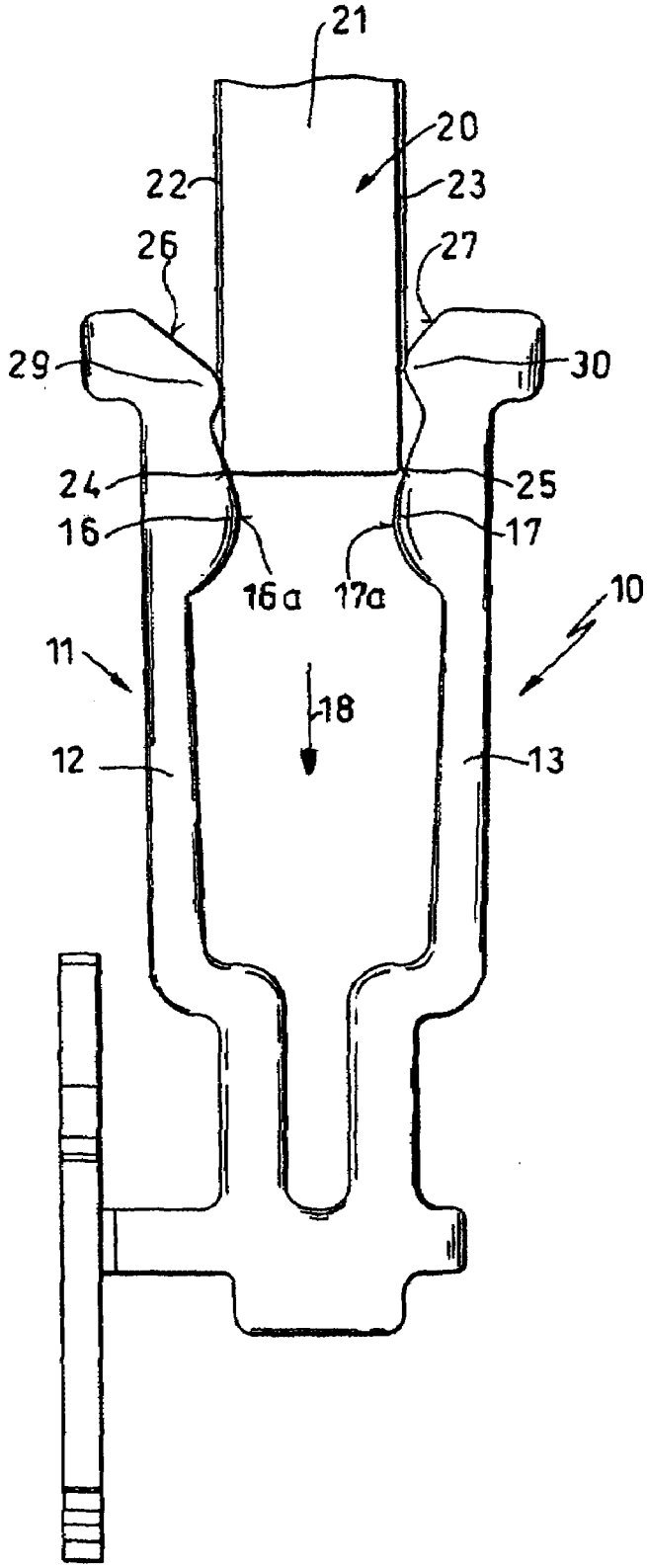
Figure 5:
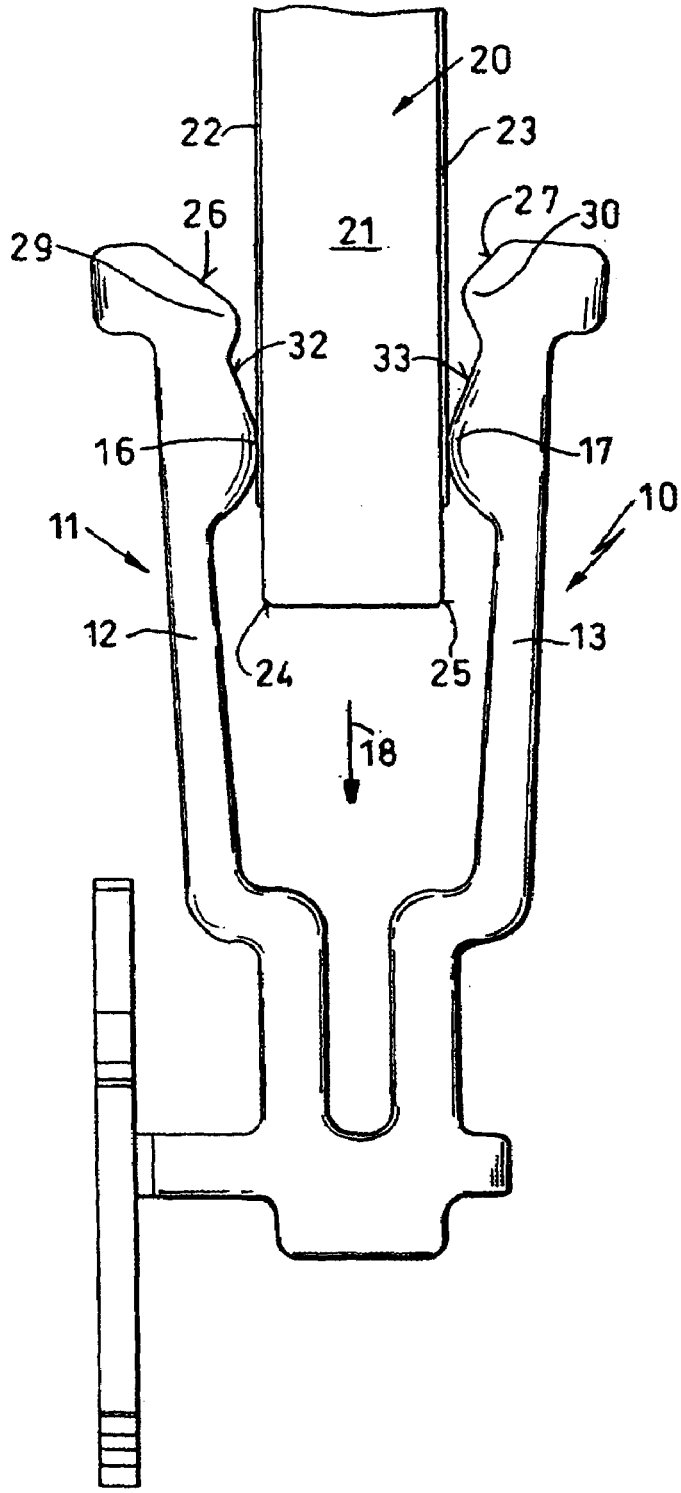

As seen in FIGS. 1 through 5, where reference numerals identical to those of FIG. 6 but without primes are used for similar structure, the contact assembly 10 has a contact 11 with two arms 12 and 13 defining a pair of contact bumps 16 and 17 that are not offset in the direction 18, but are in fact dead level with each other and symmetrically perpendicularly spaced from a central plane P. They are spaced apart perpendicular to the direction 18 by a predetermined distance or spacing $S_i$. The bumps 16 and 17 have as shown in FIG. 5 planar outer flanks 32 and 33 that extend at an angle w of 15° to the direction 18 and plane P.

The contact 11 is formed outward of the bumps 16 and 17 on the arms 12 and 13 with guide bumps 29 and 30 offset in the direction 18 by a spacing 28 and having faces 29*a* and 30*a* lying at the inner ends of respective planar mouth faces 26 and 27. Perpendicular to the insertion direction 18, the outer bumps 29 and 30 are spaced apart by an outer distance or spacing $S_o$. The face 26 extends at an angle W of about 48° to the plane P and direction 18, and the face 27 at a slightly smaller angle. As a result at their outer ends the arms 12 and 13 form a fairly wide mouth. The spacing $S_o$ between the outer bumps 29 and 30 is at most equal to the spacing $S_i$ between the inner bumps 16 and 17, and here is in fact equal thereto in the relaxed FIG. 1 position of the contact 11.

Figure 1:
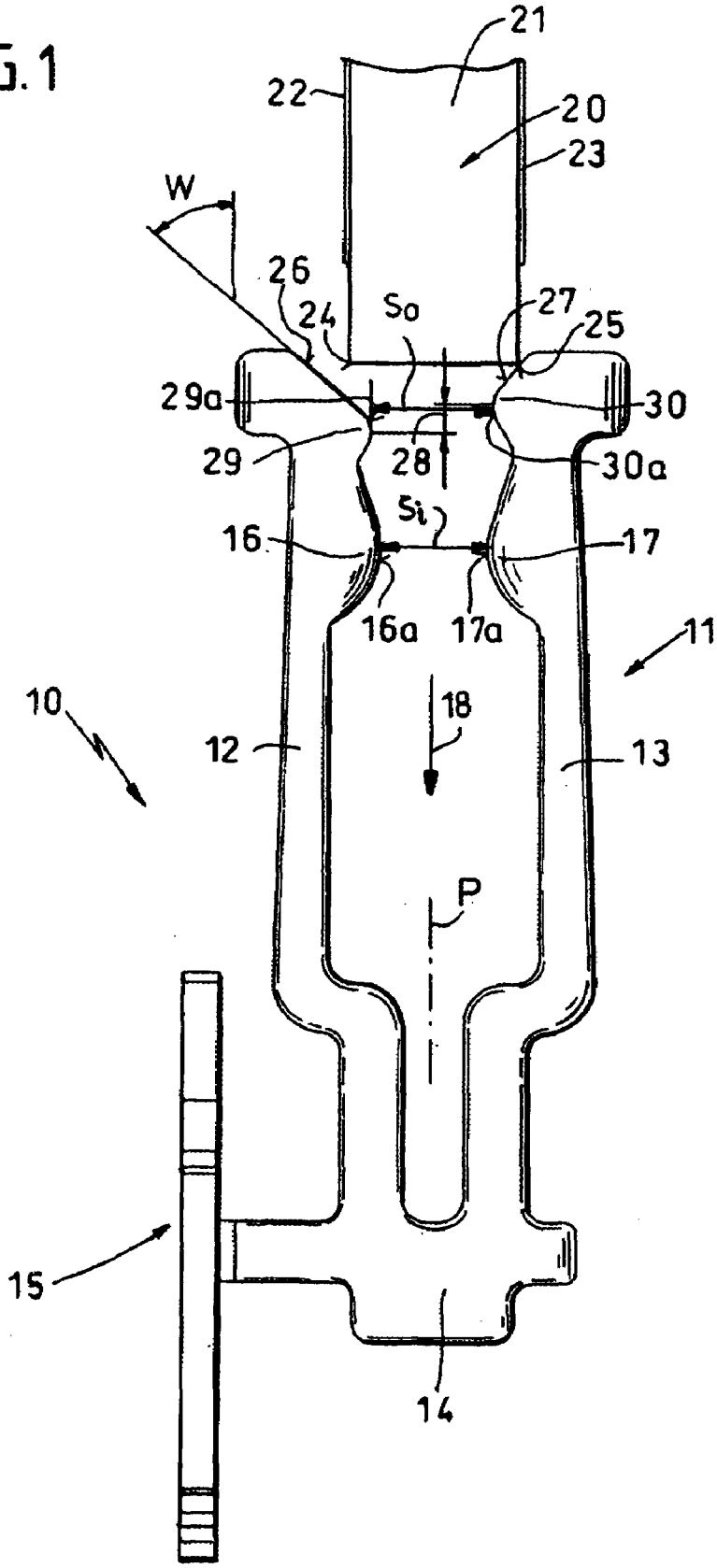
FIG. 1 is a side view of the contact according to the invention at the very start of the steps fitting another contact to it.
Figure 2:
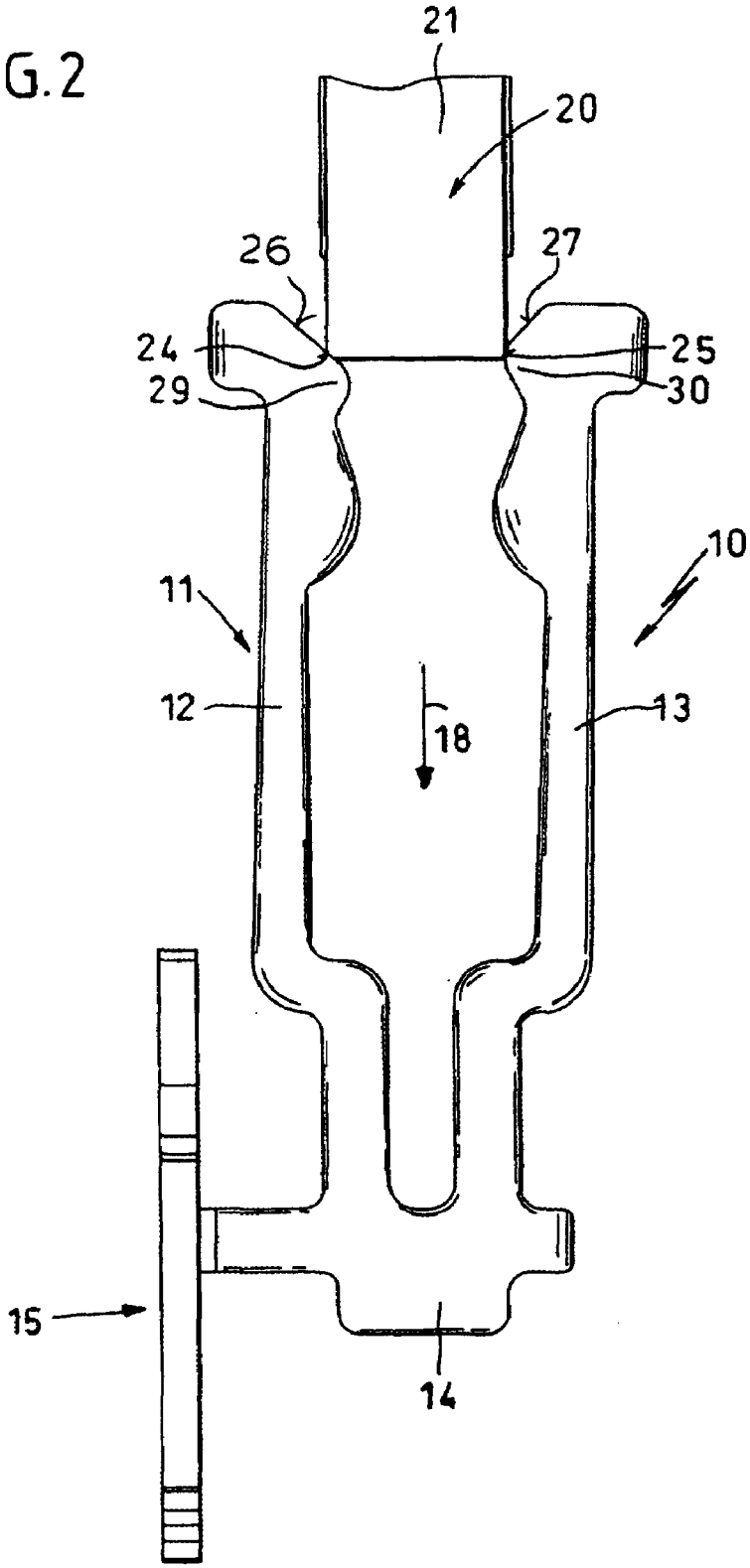
FIGS. 2 through 5 are successive views like FIG. 2 showing the remaining steps in the contact-fitting operation.

As shown in FIG. 1, the board 20 has as in FIG. 6 a rigid core 21 with surface traces 22 and 23, but its edges 24 and 25 are not beveled and are in fact square. As this square-edged board 20 is fitted to the assembly 11, moving inward in the direction 18 and centered on the plane P, it will first contact the somewhat less angled face 27 with its corner 25, then as shown in FIG. 2 its corner 24 will contact the face 26. This contact with the face 26 will, however, only take place once the edge 25 has slid to the very summit of the bump 30, that is to the end of the face 27. Further movement in the direction 18 as shown in FIG. 3 pushes the arms 12 and 13 apart so that the faces of the core board 21 slide down on the bumps 29 and 30. At any one time, only one or the other of the faces 26 and 27 is being engaged by the part 20 as a result of the thickness of the part 20 relative to the distances $S_o$ and 28. This action of the edges 24 and 25 sliding over the faces 26 and 27 burnishes and smooths these edges 24 and 25.

By the time as shown in FIG. 4 that the edges 24 and 25 engage the surfaces 16*a* and 17*a*, the arms 12 and 13 are already sufficiently spread that these edges 24 meet these rounded surfaces 16*a* and 17*a* at a very flat angle and only need to spread the legs 12 a tiny bit to fit between them for full insertion as shown in FIG. 5, when the bumps 16 and 17 actually contact the traces 22 and 23. Thus the engagement of the edges 24 and 25 with the bumps 16 and 17 is quite gentle, taking place at the angle w of 15°, and the edges 24 and 25 have been smoothed or burnished by sliding over the faces 26 and 27. The result is that this contact 11 will have a very long service life. Even if its outer faces 26 and 27 are somewhat chewed up, in fact completely scraped clear of any conductive material, this will have no effect on the quality of the electrical connection once the part 20 is fully inserted into the contact assembly 10 and the rounded surfaces 16*a* and 17*a* come to rest on the traces 22 and 23.

The contact 11 according to the invention could also be made as a flat-spring contact, an MID contact, or of other similar construction. Similarly the part 20 could be a printed-circuit board as shown, a blade contact, an MID contact, or the like.

I claim:

1. In combination with a circuit part having a pair of opposite faces terminating at respective edges, an electrical contact comprising:

a pair of arms extending generally parallel to and spaced apart transversely of an inward insertion direction, each having an outer end and an inner end, and defining a slot open outwardly against the insertion direction, each arm outer end having an end face extending at an acute outer angle to the direction, the end faces diverging outward from each other against the direction;

a bight interconnecting the arm ends, the arms being limitedly elastically deformable for elastic displacement of the arm outer ends perpendicular to the direction;

an inner contact bump projecting on each arm between the respective end face and the bight transversely of the direction into the slot, the inner bump being spaced apart tranverse to the direction by a predetermined inner spacing equal to less than a transverse distance between the circuit-part faces such that when the part is pressed in the insertion direction against the end faces its edges engage the end faces and elastically spread the arm outer ends while the end faces round the edges, the inner bumps each having a flat outer flank forming to the direction an inner angle smaller than the outer angle formed between the end faces; and an outer bump projecting on each arm from between the respective inner bump and the respective end face transversely of the direction into the slot, the outer bumps being spaced apart transverse to the direction by a predetermined outer spacing equal at most to the inner spacing.

2. The electrical contact defined in claim 1 wherein in a relaxed condition of the contact the inner and outer spacings are generally the same.

3. The electrical contact defined in claim 1 wherein the acute outer angle is betwwen 40° and 55°.

4. The electrical contact defined in claim 1 wherein the inner angle is between 15° and 30°, the outer flanks diverging outward against the direction.

5. The electrical contact defined in claim 1 wherein the bumps are unitarily formed with the respective arms.

6. The electrical contact defined in claim 1 wherein the inner bumps are spaced directly across from each other perpendicular to the direction.

7. The electrical contact defined in claim 1 wherein one of the outer bumps is spaced in the direction outward of the other of the outer bumps.

* * * * *